United States Patent [19]

Doiron

[11] Patent Number: 4,590,836

[45] Date of Patent: May 27, 1986

[54] SAFETY CHAIN FOR CHAIN SAWS

[75] Inventor: Gerald J. Doiron, Hyannis, Mass.

[73] Assignee: Omark Industries, Inc., Portland, Oreg.

[21] Appl. No.: 552,825

[22] Filed: Nov. 17, 1983

[51] Int. Cl.[4] ..... B27B 33/14

[52] U.S. Cl. ..... 83/834; 83/830; 83/DIG. 1

[58] Field of Search ..... 83/830–834, 83/DIG. 1, 544, 814; 30/381, 382

[56] References Cited

U.S. PATENT DOCUMENTS

| | | | |
|---|---|---|---|
| 3,329,183 | 7/1967 | Robinson | 83/834 |
| 4,074,604 | 2/1978 | Goldblatt | 83/830 |
| 4,279,100 | 5/1981 | Deelman | 83/834 |
| 4,353,277 | 10/1982 | Silvon | 83/834 X |
| 4,430,795 | 2/1984 | Wetzel et al. | 30/382 |

*Primary Examiner*—E. R. Kazenske
*Assistant Examiner*—John L. Knoble
*Attorney, Agent, or Firm*—John W. Stuart

[57] ABSTRACT

A cutting chain for a chain saw including a clearer immediately in front of the cutter tooth, the clearer normally extending past the cutter tooth and preventing cutting but depressible by a solid object such as wood to allow cutting.

12 Claims, 8 Drawing Figures

SAFETY CHAIN FOR CHAIN SAWS

BACKGROUND OF THE INVENTION

Attention is directed to co-pending application Ser. No. 544,783 filed Oct. 24, 1983, now abandoned, directed to very similar novel material. The main consideration in both inventions is the same; i.e., safety. The manner that this is achieved is to provide a safety member for each cutting tooth in the chain with a construction such that in contact with a soft body, e.g. human, the chain will not cut, but in contact with a hard body, e.g. wood, the chain will cut as usual. Also "kick-back" is eliminated (except in one form of the invention).

SUMMARY OF THE INVENTION

In all cases, the safety member extends past the cutter; i.e., outwardly of the cutter bar, in safety position, and the relative positions are reversed in cutting position. This is done automatically with no attention or action on the part of the operator. All saw chains have a certain amount of longitudinal tension when applied to the cutter bar, and this tension keeps the chain in safety condition at all times when the hard body, e.g. wood, is not encountered. The tension keeps the pivots that articulate the chain elements in a straight line in the cutting area of the cutter bar, but certain pivots can recede toward the cutter bar when the hard body is encountered, thus relatively projecting the teeth to cutting position. Several chain constructions have been discovered to provide this action. One such construction is presented in the application above referred to. Others, more particularly described hereinafter are:

I—Safety member on drive links, motion stops on adjacent drive links; cutter on separate link;

II—Cutter and safety on same link, pivot adjacent cutter;

III—Cutter and Safety on adjacent links, stops on cutter link and safety (drive) link.

The safety may also be the clearer as in the application identified.

PREFERRED EMBODIMENTS OF THE INVENTION

Figure 2:
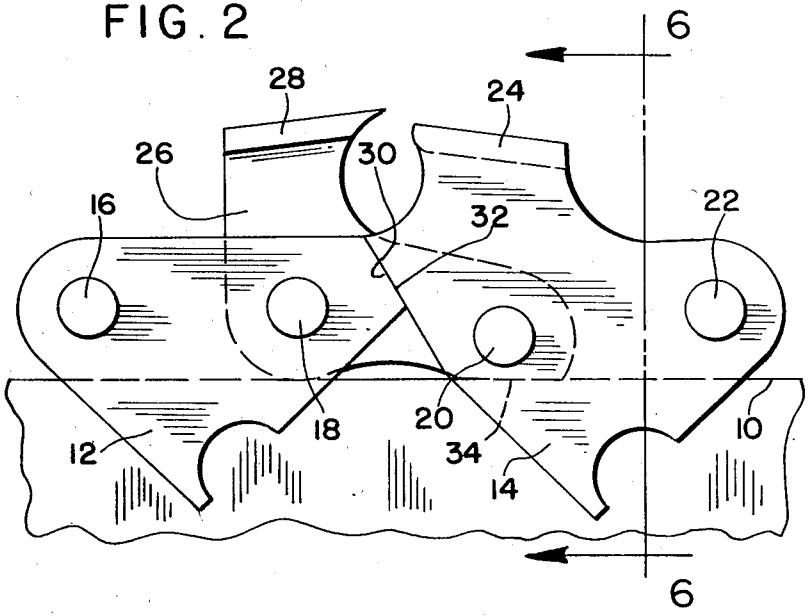
FIG. 2 is the same as FIG. 1, but in cutting condition.
Figure 1:
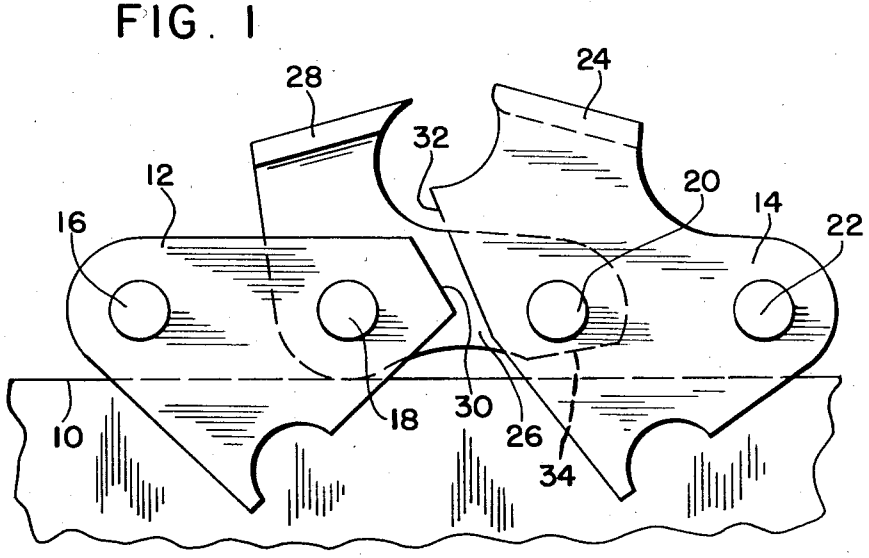
FIG. 1 is a side elevational view representing a form of the invention in safety condition.

Only so much of the apparatus is shown as to fully understand the invention. In FIGS. 1 and 2, the line 10 is representative of the top edge of the cutter blade or bar peripheral kerf. The driver links 12 and 14 travel with a portion in the kerf as well known, and the rest of the chain is exposed. There are here shown pivot pins 16, 18, 20, and 22 which articulate the chain. The driver links are not alike, but each serves to drive. Driver link

14 has the laterally extending safety member 24, also referred to herein as clearing means on it, but driver link 12 has no safety member nor cutting tooth. These two driver links are articulated by the cutting tooth link 26 and pivot pins 18 and 20, the cutting tooth 28 being per se substantially conventional and of a width (transverse to the cutter bar) to be protected by the safety member 24 in FIG. 1 position. Driver link 12 may have a front edge stop portion 30 and driver link 14 may have a cooperating rear edge stop portion 32.

The axes of pivot pins 16, 18, 20, 22 are normally held in a straight line; e.g. parallel to the line 10, when the saw is running but not sawing, FIG. 1. In this situation, any soft body encountered by the chain will not be cut because safety member 24 is above the cutting edge of tooth 28; i.e., projecting outwardly of the cutter bar to a greater extent than the cutter. But when the saw is applied to a hard body; e.g. a piece of wood, the driver link 14 is forced "down"; i.e., it pivots counterclockwise about pin 22 as a pivot, from the FIG. 1 position, to the FIG. 2 position, pivot pin 20 receding as allowed by the space between stops 30 and 32 or the space between edge 34 and the cutter bar edge 10. The cutter link 26 pivots clockwise, and the tooth's elevation is not significantly changed whereas the elevation of the safety member 24 drops down to a degree allowing the tooth to cut. Upon release from the piece being sawed, the chain tension reverses this condition, back from FIG. 2 position, cutting, to FIG. 1 position, safety.

Figure 4:
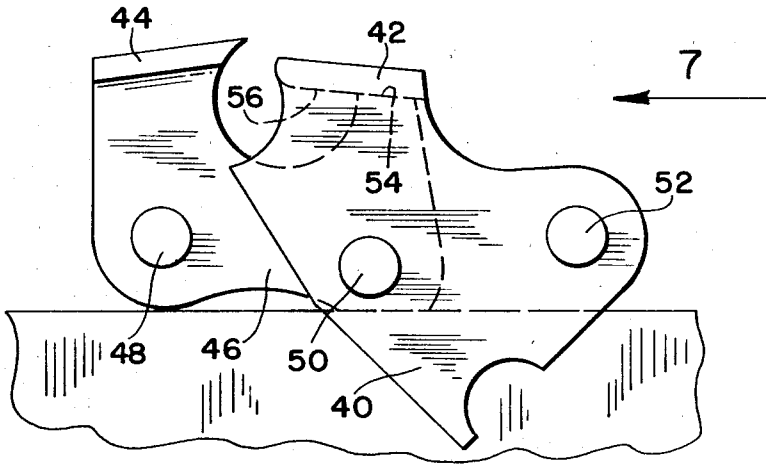
FIG. 4 is the same as FIG. 3 but in cutting condition.
Figure 3:
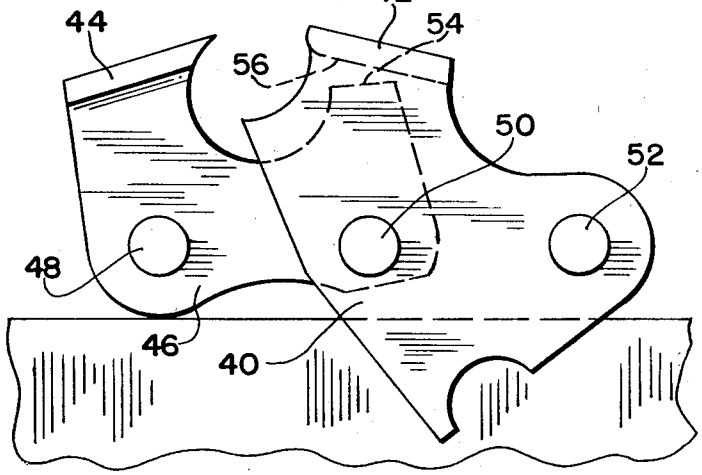
FIG. 3 is a side elevational view representing another form of the invention in safety condition.
Figure 7:
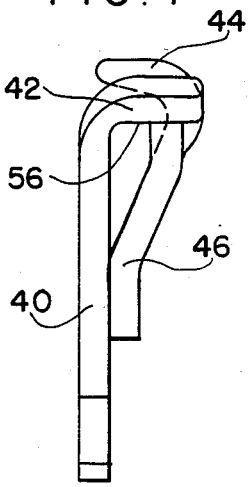
FIG. 7 is an end elevational view taken along line 7 in FIG. 4.
Figure 8:
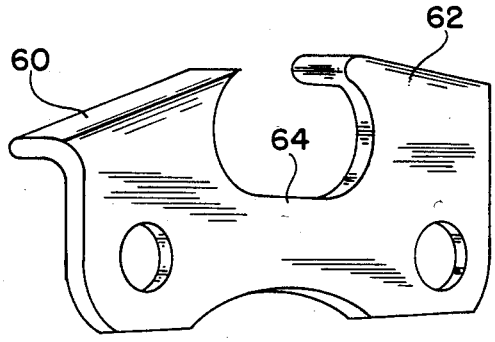
FIG. 8 is a perspective view of the combined cutting and safety link of FIG. 5.

Referring to FIGS. 3 and 4, the driving portion of driver link 40 is the same as before as is the safety member clearing means 42, it being noted that the safety member extends laterally enough to protect the tooth 44 on link 46, see FIG. 7. The pivot pins are numbered 48, 50, and 52, and the action is similar to that above described, except that the stops are at leading edge 54 of cutter link 46 and at the underside 56 of the lateral part of the safety member 42. This will be apparent from an inspection of FIGS. 3 and 4. In FIG. 3, the chain tension maintains the driver link 40 in normal, safe position, until a hard body is encountered, causing driver link 40 to pivot in a counter clockwise direction to cutting position, as before, as long as the chain is against a hard body; i.e. hard enough to depress the safety members.

Figure 5:
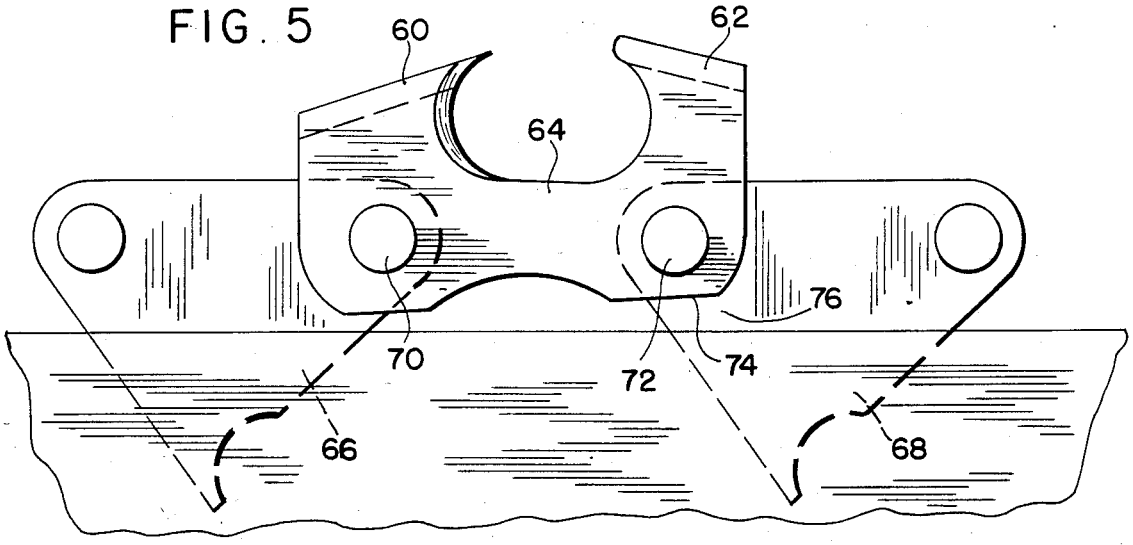
FIG. 5 is a side elevational view of another form of the invention in safety condition.
Figure 6:
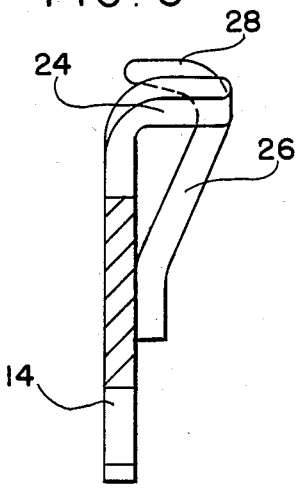
FIG. 6 is a sectional view taken on line 6—6 of FIG. 2.

In the form of the invention in FIG. 5, the cutting tooth 60 and safety member 62 are on the same link 64, a significant difference from the other forms of the invention. This link is articulated to similar driving links 66 and 68 by pivot pins 70 and 72. The link 64 is reduced at 74, adjacent to the safety member 62, but about 180° from the latter about the axes of pin 72. The equivalent area 76, in corresponding position to the tooth 60, is not so reduced, and the result is that normally the safety member 62 projects beyond the cutter tooth under normal conditions of non-use, but under sawing operations, driver link 68 pivots counter clockwise, link 64 pivots clockwise, and safety member 62 is retracted below the cutter tooth, which scarcely moves at all.

I claim:

1. A chain for a chain saw having the usual cutter bar with a substantially straight portion along which the chain travels, said chain comprising in-line articulated cutting tooth elements, cutting teeth on said elements, additional elements in the line of the cutting teeth, safety members on the additional elements leading said cutting teeth, said additional elements being shiftable between two positions with respect to the cutting tooth elements in the chain as the chain travels along the substantially straight portion of the bar, said positions including one in which said safety members, in the absence of pressure on the chain toward the bar, normally project beyond the cutting teeth and prevent them from cutting and another position with the safety members retracted with respect to the cutting teeth and allowing cutting, and means limiting the degree of retraction.

2. The chain of claim 1 wherein the said means comprises stops.

3. The chain of claim 2 wherein the stops are located on the cutting tooth elements and on the additional elements.

4. The chain of claim 3 wherein said stops interengage to perform their stopping action.

5. The chain of claim 4 including pins articulating the elements and wherein tension is applied to the chain about the bar normally maintaining the pins in a single line, but at the same time allowing the retraction of certain pins upon contact thereof with a relatively hard substance, and stops limiting the degree of retraction of the safety members.

6. The chain of claim 5 wherein the stops interengage to accomplish the stopping action, and are located on the respective cutting tooth elements and additional elements.

7. The chain of claim 6 wherein the stops are located on adjacent in-line edges of the elements.

8. The chain of claim 6 wherein the safety members include a laterally extending clearing means.

9. The chain of claim 8 wherein said laterally extending clearing means forms a stop on each safety element.

10. A chain for a chain saw having a peripherally grooved cutter bar with a substantially straight portion along which the chain travels, the chain comprising a series of in-line articulated links including driving links and cutting links, pivot pins connecting the links, said pins normally being held in line by the tension of the chain on the cutter bar, each cutting link including a cutter tooth spaced in relation to a safety member, each cutter tooth and safety member being disposed adjacent respective pivot pins, the pivot pin adjacent the safety member being depressible upon engagement of the safety member with a hard body to retract the safety member from a position preventing cutting by the tooth to a position allowing cutting, the safety member normally being located in safety position relative to the cutting tooth in non-cutting position as the chain travels along the substantially straight portion of the bar in the absence of external pressure on the chain in a direction toward the bar, the pivot pin adjacent the tooth being relatively non-depressible.

11. A saw chain comprising a plurality of links joined by pivot connections, said links bearing a cutter member which projects outwardly from said pivot connections a first distance and a safety member leading said cutter member, said safety member mounted in said chain to extend outwardly beyond said first distance to inhibit cutting when the chain is normally tensioned and is running in a substantially straight line without pressure applied thereto in a direction toward said pivot connections, and being retractable to a position spaced inwardly toward said pivot connections from said first distance solely upon application of pressure to said safety member in a direction toward said pivot connections to expose the cutter member permitting cutting.

12. The saw chain of claim 11, which further comprises means limiting the degree of retraction of said safety member.

* * * * *